United States Patent [19]

Watson

[11] Patent Number: 4,926,520

[45] Date of Patent: May 22, 1990

[54] METHOD AND APPARATUS FOR CLEANING CARPET TILES

[76] Inventor: Claude F. Watson, 19 Harvest La., Greenville, S.C. 29601

[21] Appl. No.: 80,429

[22] Filed: Jul. 31, 1987

[51] Int. Cl.[5] ..... A47L 11/00

[52] U.S. Cl. ..... 15/302; 15/306 B; 15/77; 15/309; 15/308; 28/159; 8/151; 68/158

[58] Field of Search ..... 15/302, 306 B, 306 A, 15/308, 309, 314, 158, 31, 77; 28/159; 26/2 R; 8/151; 68/27, 35

[56] References Cited

U.S. PATENT DOCUMENTS

| | | | |
|---|---|---|---|
| 1,183,672 | 5/1916 | Ritchey | 15/77 |
| 1,885,464 | 11/1932 | Miller | 15/302 |
| 1,930,575 | 10/1933 | Wynd | 15/308 X |
| 2,363,631 | 11/1944 | Walters | 15/77 X |
| 2,729,536 | 1/1956 | Pull | 15/302 |
| 2,986,149 | 5/1961 | Brakel | 15/77 X |
| 3,046,774 | 7/1962 | Glock | 15/77 X |
| 3,333,291 | 8/1967 | Hondzinski | 15/302 |
| 3,396,422 | 8/1968 | Haverberg | 15/308 |
| 3,574,526 | 4/1971 | Bell | 15/308 X |
| 3,589,147 | 6/1971 | Price | 26/2 R |
| 3,705,437 | 12/1972 | Rukavina | 15/302 |
| 4,103,389 | 8/1978 | Resnick | 15/302 |
| 4,268,929 | 5/1981 | Sörensen | 15/306 A |
| 4,624,023 | 11/1986 | Fleissner | 26/2 R |
| 4,733,422 | 3/1988 | Schramm et al. | 15/77 |

*Primary Examiner*—Harvey C. Hornsby
*Assistant Examiner*—K. O'Leary
*Attorney, Agent, or Firm*—Dority & Manning

[57] ABSTRACT

A method and apparatus for cleaning carpet tiles is disclosed. The apparatus which accomplishes the present method includes a machine having a frame structure, a loading station connected to the frame structure and adapted for receiving a carpet tile, and an unloading station connected to the frame structure and adapted for allowing removal of a carpet tile from the machine. Infeed rollers are provided a cleaning compartment of the machine for continuously propelling a carpet tile from the loading station and over a nozzle bank which subjects the pile side of the carpet tile to a cleaning fluid spray. A scrubbing roller then scrubs the pile side of the carpet tile, and the carpet tile is next propelled over rinsing nozzles which rinse the cleaning fluid therefrom. After passing over the rinsing nozzles, the carpet tile is propelled from the cleaning compartment and to the unloading station by outfeed rollers which both squeeze excess fluid from the carpet tile and move the carpet tile over a vacuum slot which vacuums residual fluid therefrom.

6 Claims, 5 Drawing Sheets

METHOD AND APPARATUS FOR CLEANING CARPET TILES

BACKGROUND OF THE INVENTION

This invention relates to a method and a machine for cleaning a carpet tile in a continuous manner.

Carpet tiles are used typically as a floor surface covering and are generally rectangular in shape. Carpet tiles are most commonly square and are applied to a floor surface similarly as are conventional floor tiles, with the edges of each carpet tile being in abutment with the edges of another carpet tile or vertical surfaces such as walls. Typically, no adhesive is required for applying the carpet tile to the floor surface. The abutting interference fit between a carpet tile and those adjacent to it is sufficient for retaining the carpet tile substantially fixed relative to the floor surface during normal use. Once applied to a floor surface, the carpet tiles are generally removable therefrom by merely pulling them upward by hand from the floor surface.

One particular advantage of using carpet tiles is that when a path becomes worn across the carpeted surface, only those carpet tiles under the path need be replaced, thereby allowing carpet tiles which are not excessively worn to remain. This eliminates the need of recarpeting the whole flooring surface and allows for only those portions which are excessively worn to be selectively replaced.

Another advantage of using carpet tiles is that they may be readily pulled up from the floor surface, cleaned, and reapplied to the floor surface. This allows for an improved life and appearance of the carpet tiles while they remain suitable for use as a floor covering.

There are patented devices for cleaning substantially flat articles. For example, U.S. Pat. No. 3,396,422, granted to Haverberg, entitled, "Car Mat Washing Machine", discloses a machine which washes and dries automobile floor mats. The machine has a mat supporting grating and rotary brushes for conveying liquid to and scrubbingly engaging one side of an automobile floor mat through the grating. Infeed rolls are provided for feeding a floor mat to the rotary brushes. Also provided is a pressure plate pivotally mounted over the rotary brushes for holding a floor mat against the rotary brushes. Outfeed rollers impart a squeezing action to the floor mat when fed therebetween, and a fan is provided for blowing air over the floor mat for the drying thereof. Another cleaning machine for cleaning substantially flat articles is disclosed in U.S. Pat. No. 1,183,672, granted to Ritchey et al., which includes wire bristle rollers for cleaning baking pans transferred on a conveyor. Also, a sheet drying apparatus is disclosed in U.S. Pat. No 1,930,575, granted to Wynd et al., which includes infeed rollers, washer spray pipes, brush rollers, outfeed rollers, and a pressurized air nozzle assembly which are all used in conjunction for drying sheets of material, such as the glass and celluloid used in the manufacture of laminated glass.

Of the above patented devices, however, none is particularly adapted for automatically thoroughly cleaning, rinsing, and vacuuming carpet tiles.

SUMMARY OF THE INVENTION

The present invention recognizes and addresses such drawbacks of the prior art. Thus, it is a general object of the present invention to provide a machine for automatically cleaning carpet tiles.

Another object of the present invention to provide a machine which automatically wets a carpet tile with cleaning fluid, and then scrubs, rinses, and vacuums the carpet tile.

Another object of the present invention is to provide a carpet tile cleaning machine which can be readily installed in a variety of environments.

Still another object of the present invention is to provide a carpet tile cleaning machine which can clean a variety of sizes of carpet tiles.

Yet another object of the present invention is to provide a method for cleaning a carpet tile.

Various combinations of presently disclosed features may be provided in a given embodiment thereof in accordance with this invention. Generally, one such exemplary embodiment of the present invention includes a carpet tile cleaning machine comprising a frame structure, a loading station connected to the frame structure and adapted for receiving a carpet tile, and an unloading station connected to the frame structure and adapted for allowing removal of a carpet tile from the carpet tile cleaning machine. Scrubbing means are connected to the frame structure between the loading station and the unloading station and are adapted for scrubbing a carpet tile. Infeed means are connected to the frame structure between the loading station and the scrubbing means and are adapted for transferring a carpet tile from the loading station and about the scrubbing means. Wetting means are provided between the infeed means and the scrubbing means and are adapted for wetting a carpet tile with a cleaning fluid. Outfeed means are connected to the frame structure and are adapted for transferring a carpet tile from about the scrubbing means to the unloading station. Rinsing means are provided between the scrubbing means and the outfeed means and are adapted for rinsing a carpet tile with a rinsing fluid. Vacuum means are associated with the outfeed means and the unloading station and are adapted for vacuuming rinsing fluid from a carpet tile after exposure of the carpet tile to the rinsing means.

The present invention also includes a method of cleaning a carpet tile having a pile side and a backing side. The method comprises infeeding a carpet tile with infeed rollers into a carpet tile cleaning compartment of a carpet tile cleaning machine, wetting the pile side of the carpet tile with wetting nozzles in the carpet tile cleaning compartment of the carpet tile cleaning machine, the pile side of the carpet tile being wetted with a cleaning fluid by the wetting nozzles. The method further includes scrubbing the pile side of the carpet tile in the carpet tile cleaning compartment of the carpet tile cleaning machine with a rotary scrubbing brush after wetting of the pile side by the cleaning fluid of the wetting nozzles. After scrubbing, the method includes rinsing the pile side of the carpet tile with rinsing nozzles in the carpet tile cleaning compartment of the carpet tile cleaning machine, the pile side being rinsed by the rinsing nozzles with a rinsing fluid. After rinsing, the method further includes vacuuming the pile side of the carpet tile with a vacuum slot of the carpet tile cleaning machine for removing the rinsing fluid from the pile side thereof.

Other features of the present invention will be apparent from the following specification and the drawings appended thereto.

BRIEF DESCRIPTION OF THE DRAWINGS

The foregoing as well as other objects of the present invention will be more apparent from the following detailed description of a preferred embodiment of the invention, including the best mode thereof, when taken together with the accompanying drawings, in which.

DESCRIPTION OF THE PREFERRED EMBODIMENT

Figure 1:
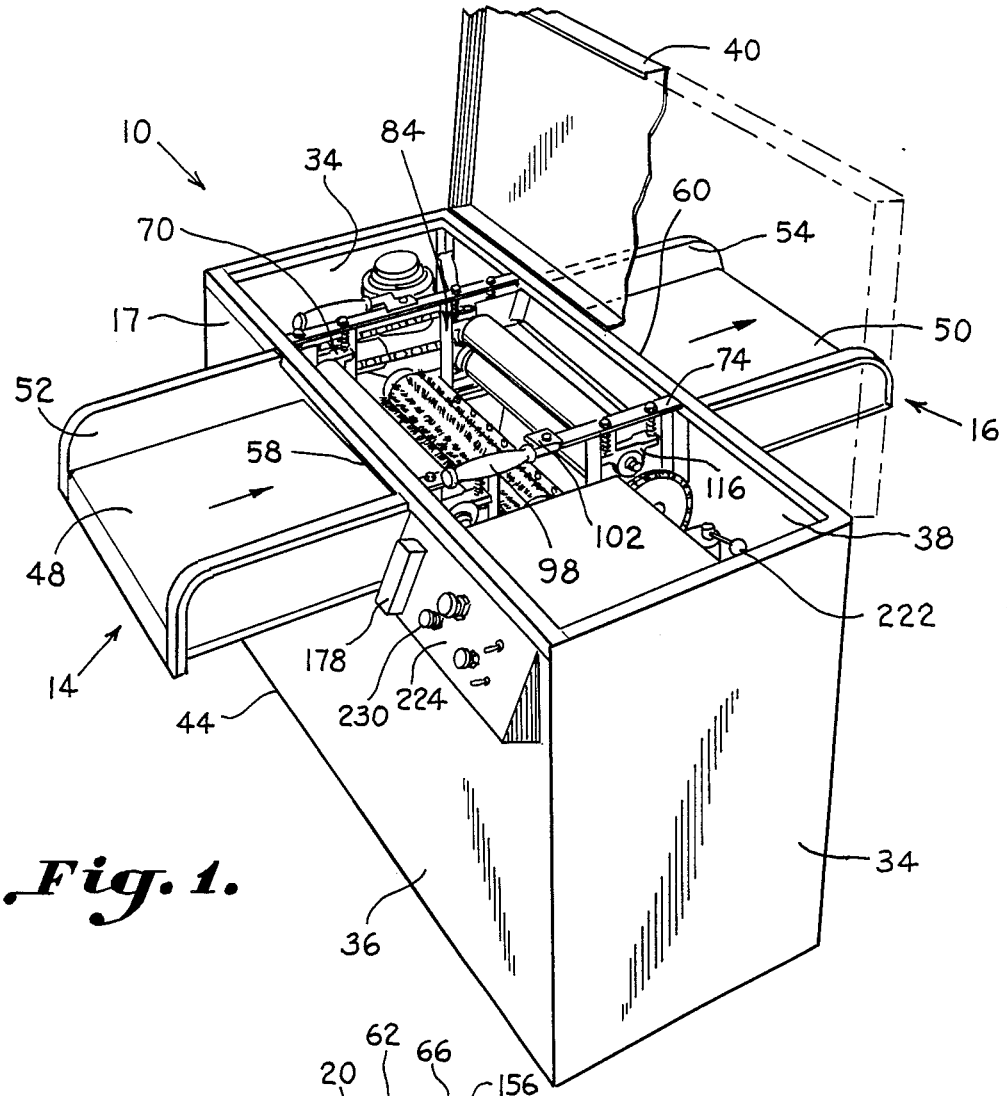
FIG. 1 is a perspective view of a carpet tile cleaning machine constructed in accordance with the present invention.
Figure 2:
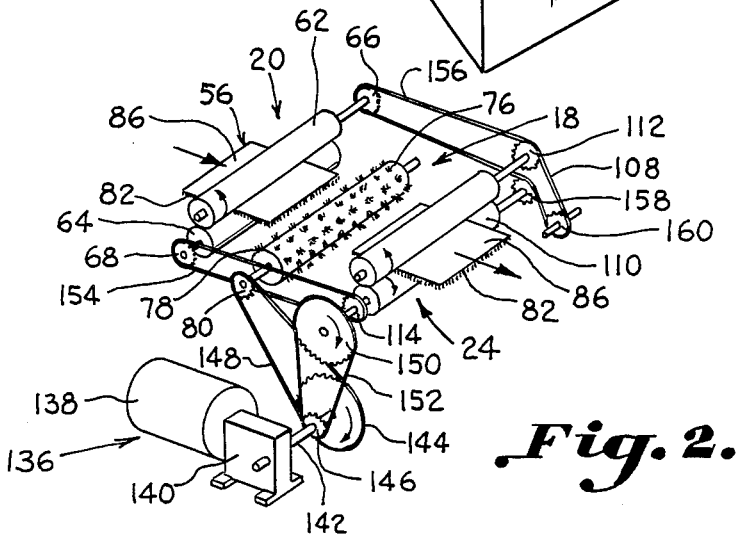
FIG. 2 is a partial perspective view of features such as the infeed means, the scrubbing means and the outfeed means used in a carpet tile cleaning machine constructed in accordance with the present invention.
Figure 4:
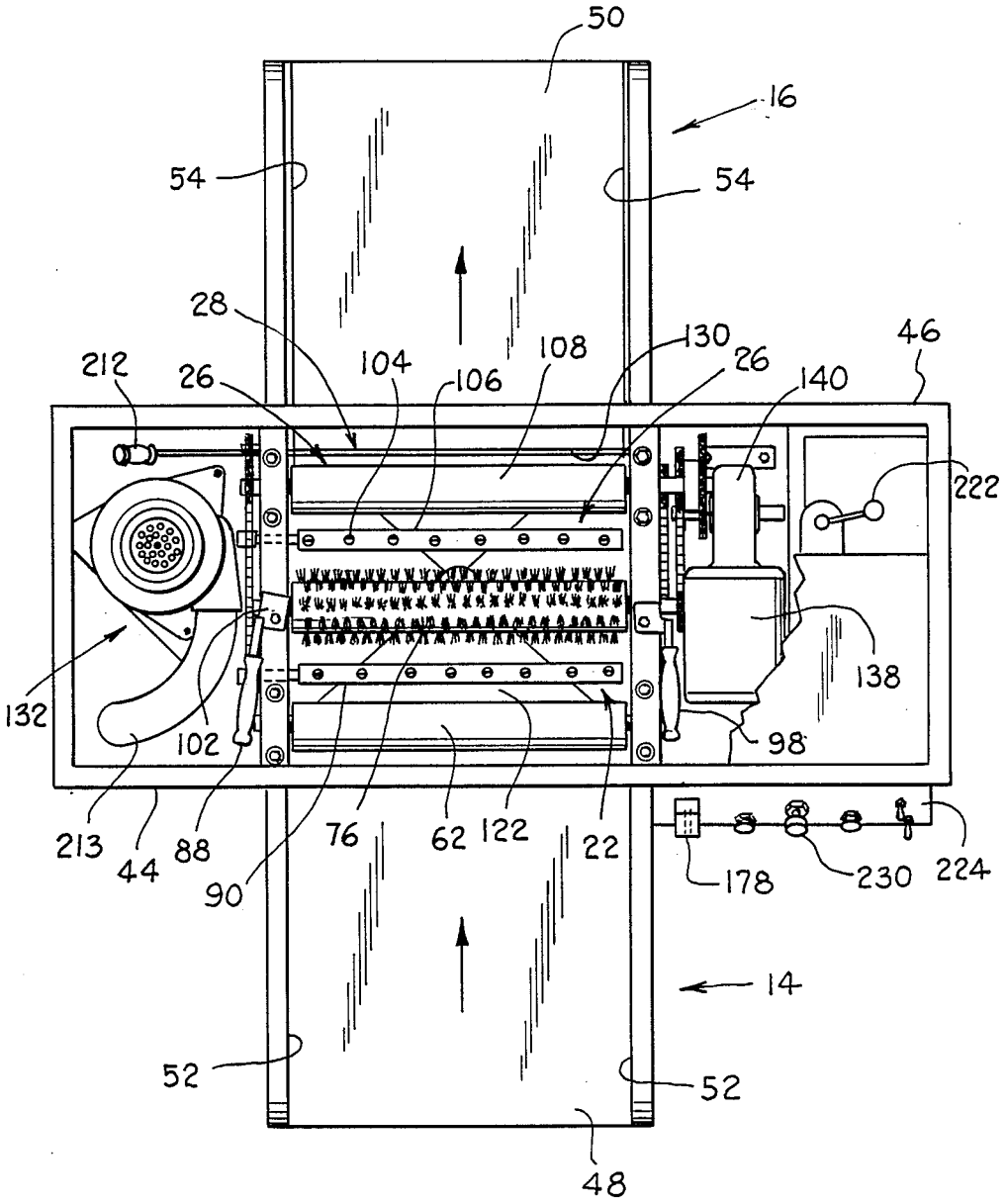
FIG. 4 is a plan view, with parts cut away of a carpet tile cleaning machine constructed in accordance with the present invention.

Referring to the drawings in detail, wherein like reference characters represent like elements and/or features throughout the various views, the carpet tile cleaning machine of the present invention is designated generally in FIG. 1 by the reference character 10. As illustrated in FIGS. 1, 2, and 4, carpet tile cleaning machine 10 includes a frame structure, generally 12, a loading station, generally 14, an unloading station, generally 16, scrubbing means, generally 18, infeed means, generally 20, wetting means, generally 22, outfeed means, generally 24, rinsing means, generally 26, and vacuum means, generally 28.

Frame structure 12 includes substantially vertical frame members, generally 30 spaced apart from one another and substantially horizontal frame members, generally 32, spanning therebetween. Vertical frame members 30 and horizontal frame members 32 are connected to one another by welding, nuts and bolts, screws, or some other suitable fastening means, and can be constructed of stainless steel, alloys, or any other suitable material. Attached to frame structure 12 are end covers 34, a front cover 36, a back cover 38, and a hinged top cover 40. Top cover 40 is hinged about an upper portion of frame structure 12 by hinge 42 and is movable between a horizontal position for covering machine 10 and a vertical position, shown in FIGS. 1 and 3, for accessing the inside of machine 10. Covers 34, 36, 38, and 40 serve, among other things, to isolate the inside of carpet tile cleaning machine from dirt, dust, and the elements, and also to hide the inside thereof from view.

Extending outwardly from the front 44 of carpet tile cleaning machine 10 is the substantially horizontal loading station 14, and extending from the back 46 of carpet tile cleaning machine 10 is the substantially horizontal unloading station 16. Loading station 14 and unloading station 16 are also preferably constructed of stainless steel, although any other suitable material could be used. Loading station 14 and unloading station 16 are provided with surfaces 48, 50 respectively, and side walls 52, 54, respectively which together are configured for supporting and guiding a carpet tile 56 as it travels to the entrance 58 and from the exit 60 of carpet tile cleaning machine 10. Loading station 14 and unloading station 16 allow for an operator of machine 10 to manually load a carpet tile 56 into the machine 10 and remove it therefrom.

Figure 3:
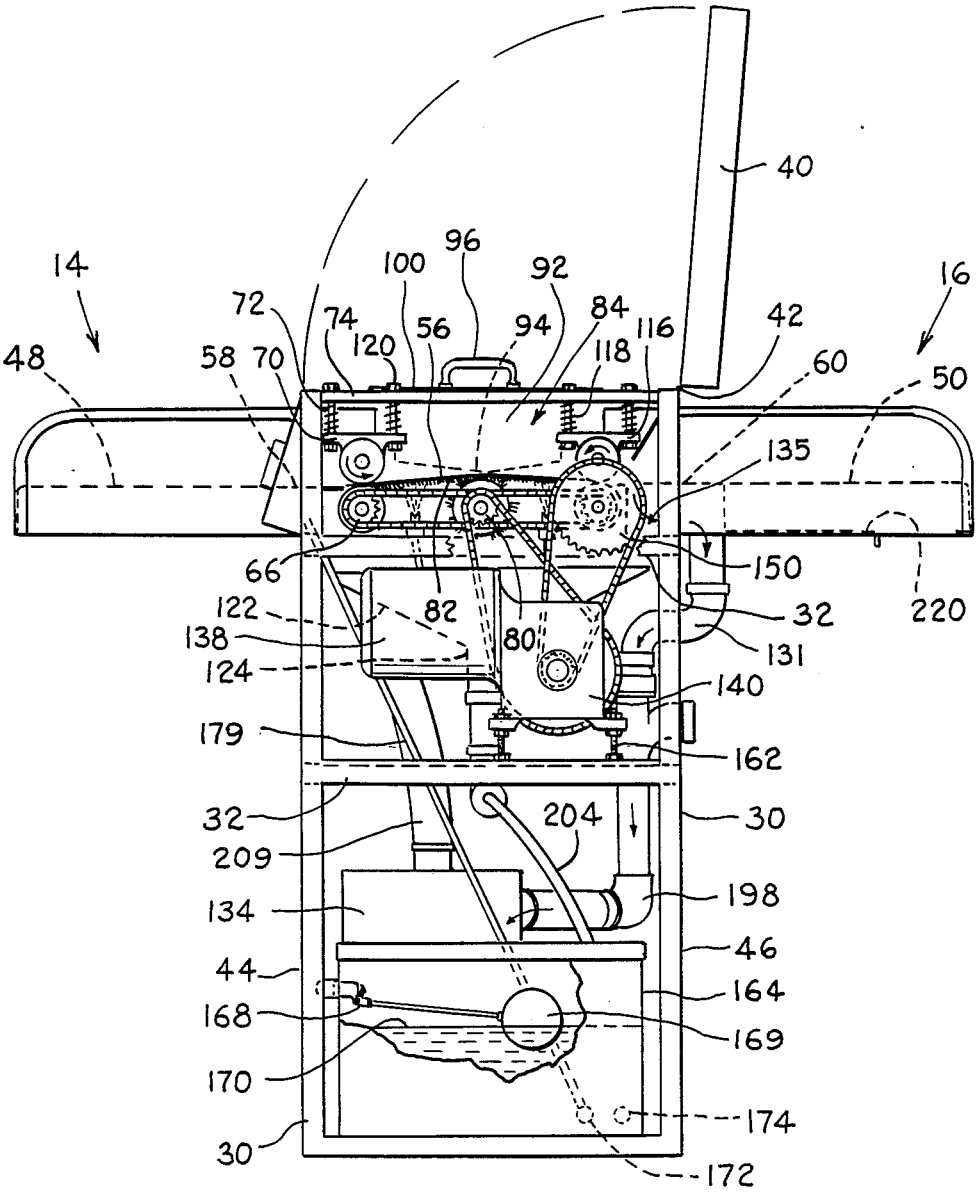
FIG. 3 is a righthand side elevational view, with parts cut away, of a carpet tile machine constructed in accordance with the present invention.

Infeed means 20 includes substantially horizontally disposed rollers 62, 64 which rotate in opposite directions with respect to one another to form a nipping zone therebetween for a carpet tile 56. Rollers 62, 64 are rotated via drive shafts connected to sprockets 66, 68. Rollers 62, 64 are preferably constructed of polyvinylchloride (PVC), but could be constructed of any other suitable material. As illustrated in FIGS. 1 and 3, roller 62 is journaled in bearing blocks 70. Bearing blocks 70 are biased downwardly by springs 72 which are connected between bearing blocks 70 and upper horizontal frame members 74.

Scrubbing means 18 includes a scrubbing roller 76 having a plurality of rows of bristles 78 extending radially outwardly therefrom. Scrubbing roller 76 is connected via a drive shaft to a sprocket 80 for rotation therewith. Scrubbing roller 76 contacts a pile side 82 of a carpet tile 56 as the carpet tile is propelled into the carpet tile cleaning compartment, generally 84, by rollers 62, 64. It is to be noted here that roller 62 contacts the backing 86 side of carpet tile 56 while roller 64 contacts the pile side 82 thereof.

Between infeed means 20 and scrubbing means 18, wetting means 22 is positioned for wetting pile side 82 of carpet tile 56 as it passes from infeed means 20 to scrubbing means 18. As shown in FIG. 4, wetting means 22 includes a series of high-pressure nozzles 88 provided in a row in a nozzle bank 90. Nozzles 88 emit high pressure streams of cleaning fluid, such as a detergent-/water mixture, or other suitable cleaning fluid mixture, for soaking pile side 82 of carpet tile 56 prior to carpet tile 56 contacting scrubbing roller 76. Thus, as carpet tile 56 is propelled into carpet tile cleaning compartment 84 by rollers 62, 64, pile side 82 is first subjected to the high-pressure cleaning fluid spray emitted from nozzle bank 90 and is then subsequently subjected to a physical scrubbing through contact with bristles 78 of scrubbing roller 76 on its flow path, indicated by arrows 91 in FIG. 6, through compartment 84.

As carpet tile 56 passes over scrubbing roller 76, it is forced against scrubbing roller 76 by a pressure plate assembly 92 having an angled bottom surface 94 which forces pile side 82 of carpet tile 56 into close proximity with bristles 78 of scrubbing brush 76 as carpet tile 56 is propelled by rollers 62, 64 through compartment 84. Pressure plate assembly 92 is preferably constructed of stainless steel, although any other suitable material may be used. Handles 96 are provided on an upper portion of pressure plate assembly 92 for allowing pressure plate assembly 92 to be inserted between upper horizontal frame members 74 and adjacent scrubbing roller 76. Pivoting latch handles 98 are pivotably attached to upper horizontal frame members 74 for engaging an upper surface 100 of pressure plate assembly 92 and served to retain pressure plate assembly 92 in position above scrubbing roller 96 when pivoted such that flanges 102 of latch handles 98 engage upper surface 100. Pivoting latch handles 98 allow for pressure plate assembly 92 to be easily secured in or removed from the machine 10. In FIGS. 1, 2, 4, and 5, pressure plate assembly 92 is shown removed from machine 10, whereas pressure plate assembly 92 is shown in place in FIGS. 3 and 6.

After passing over scrubbing rollers 76, pile side 82 of carpet tile 56 is next subjected to a rinsing spray emitted from rinsing nozzles 104 of a rinsing nozzle bank 106. The rinsing spray serves to rinse the cleaning fluid from pile side 82 which was applied by nozzles 88 of wetting means 22.

After passing over rinsing nozzle bank 106, carpet tile 56 is received by outfeed means 24. Outfeed means 24 includes substantially horizontally disposed rollers 108, 110 which are positioned relative to one another to form a nipping zone therebetween. Rollers 108, 110 are rotated oppositely relative to one another via drive shafts acting through sprockets 112, 114, respectively. Upper roller 108 is journaled in bearing blocks 116 likewise as roller 62 is journaled in bearing blocks 70. Spring 118 are provided between bearing blocks 116 and upper horizontal frame members 74 for biasing roller 108 downwardly against roller 110. It is to be noted that roller 64 of infeed means 20 and roller 110 of outfeed means 24 are both journaled beneath rollers 62, 108, respectively, for rotation in a conventional manner. It is also to be noted that bolts 120 are provided for attaching bearing blocks 70 and bearing blocks 116 to upper horizontal frame members 74, and that springs 72, 118 surround bolts 120 in biasing bearing blocks 70, 116 downwardly.

Outfeed rollers 108, 110 serve to both propel a carpet tile 56 outwardly to unloading station 16 and also to provide a squeezing action against the carpet tile 56 for squeezing residual fluid therefrom to enhance drying.

A drain pan unit 122 is provided beneath carpet tile cleaning compartment 84 for receiving cleaning fluid and rinsing fluid which is not retained by a carpet tile 56 as it passes through compartment 84. The fluid not retained by a carpet tile 56 could be that which is not absorbed thereby or that which is squeezed out by rollers 108, 110. Drain pan 122 is angled inwardly toward a central drain 124 which is connected to a drain conduit 126. Drain conduit 126 is connected to a discharge conduit 128 which is connectable with a conventional residential or commercial drainage and/or sewer system.

Figure 6:
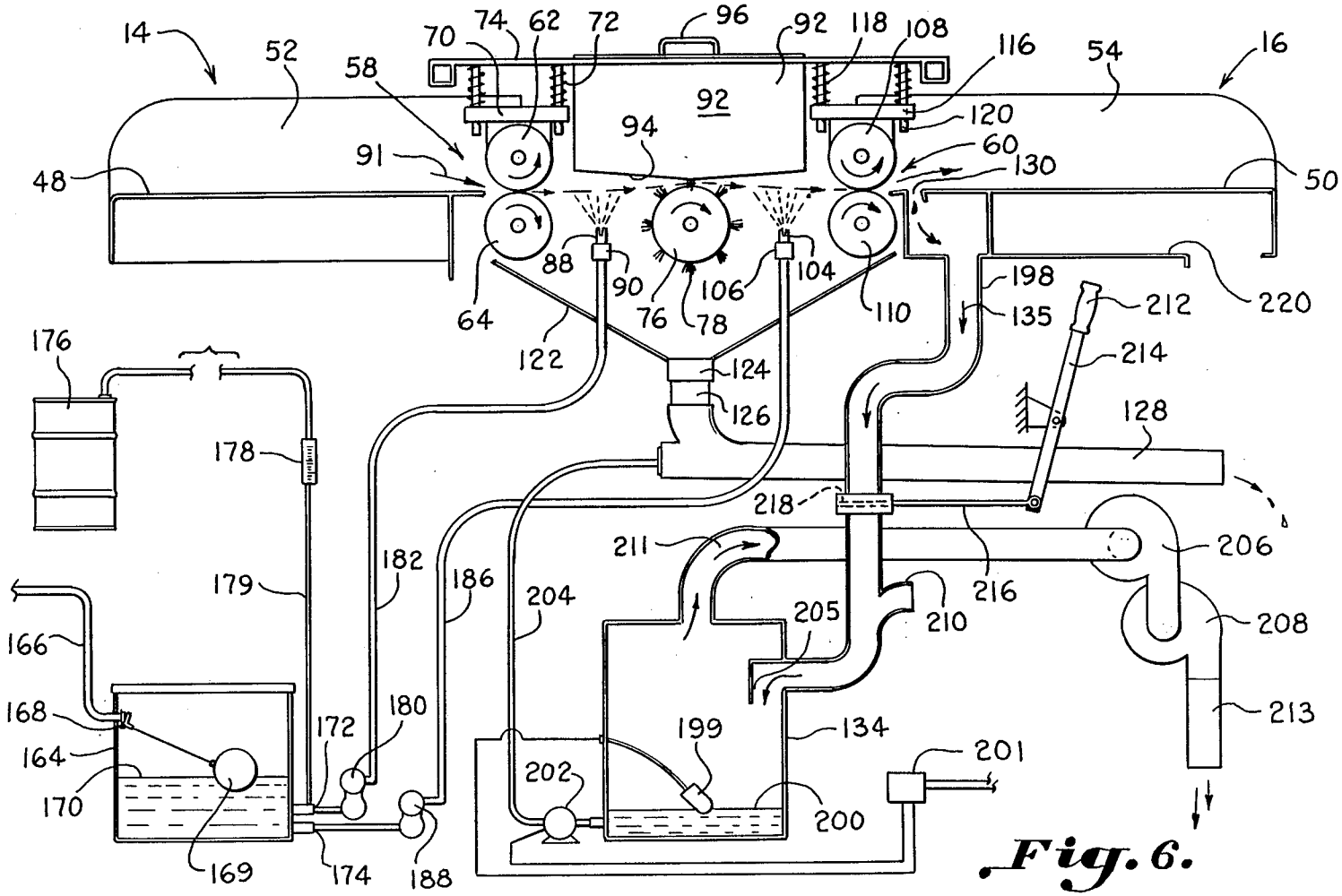
FIG. 6 is a schematic representation of the carpet tile vacuum path and fluid paths in a carpet tile machine constructed in accordance with the present invention.

After a carpet tile 56 passes through outfeed means 24, it is subjected to vacuum means 28 which includes a vacuum slot 130 which is defined in surface 50 of unloading station 16. Vacuum slot 130 is connected via a vacuum conduit 131 to the intake side of blower or vacuum pump means, generally 132. Vacuum pump means 132 may include a single mechanical or electric pump or blower or one or more pumps or blowers connected in series for pulling a vacuum through vacuum slot 130. The fluid pulled from a carpet tile 56 through vacuum slot 130 flows in the direction of arrows 135, as shown in FIGS. 3 and 6, and accumulates in a vacuumed fluid reservoir 134 which will be described in more detail hereinafter.

Infeed means 20, outfeed means 24, and scrubbing means 18 are all powered by a single drive means, generally 136. As illustrated in FIGS. 2 through 5, drive means 136 includes a reversible electric motor 138 connected to a conventional reduction drive unit 140. Extending from reduction drive unit 140 is a drive shaft 142 which has a large sprocket 144 and a small sprocket 146 attached thereto. Large sprocket 144 is connected via a chain 148 to sprocket 80 of scrubbing roller 76 for the rotation thereof upon the rotation of drive shaft 142. Small sprocket 146 is connected to a sprocket 150, which is attached to the drive shaft of outfeed roller 110, via a chain 152, such that rotation of drive shaft 142 causes corresponding rotation of sprocket 150 and outfeed roller 110. A chain 154 connects sprocket 114 of roller 110 to sprocket 68 of roller 64 for rotating same. A chain 156 is provided which is connected to a sprocket 158 of roller 110, sprocket 66 of roller 62, sprocket 112 of roller 108, and an idler sprocket 160.

Thus, upon actuation of motor 138, drive shaft 142 of reduction drive unit 140 rotates sprockets 144, 146, which in turn provide rotation to scrubbing means 18, infeed means 20, and outfeed means 24. Due to the relationship of the sprocket diameters (large sprocket 144 driving sprocket 80 and small sprocket 146 driving sprocket 150, as illustrated in FIG. 2), sprocket 80 and scrubbing roller 76 are rotated faster than sprocket 150 of the outfeed means 24. Roller 64 of infeed means 20 is rotated at the same speed as roller 110 of outfeed means 24 due to the identical sizes of sprockets 68 and 114 (as also illustrated in FIG. 2) which are rotatably connected via chain 154, thereby allowing the carpet tile 56 to pass smoothly through the machine 10. This arrangement ensures that the scrubbing roller 76 effectively scrubs the pile side 82 of the carpet tile 56 as it passes through the cleaning compartment 84. Drive means 136 is mounted by conventional mounts 162 to frame structure 12.

Turning again to wetting means 22, the cleaning fluid flow system will now be described. As best shown in FIG. 6, water from a central supply such as a city water source is introduced to a water reservoir 164 via a conduit 166, as shown by arrow 167 in FIG. 5. A conventional float actuated switch 168 having a float 169 is provided in reservoir 164 for controlling the water flow into reservoir 164 through conduit 166 in a conventional manner relative to the water level 170 within reservoir 164. When water level 170 is below a predetermined level, float 169 is in a lowered position, which in turn causes activation of switch 168 to allow water into water reservoir 164. When water level 170 again reaches the predetermined level, float 169 is in a raised position, which in turn causes deactivation of switch 168.

Figure 5:
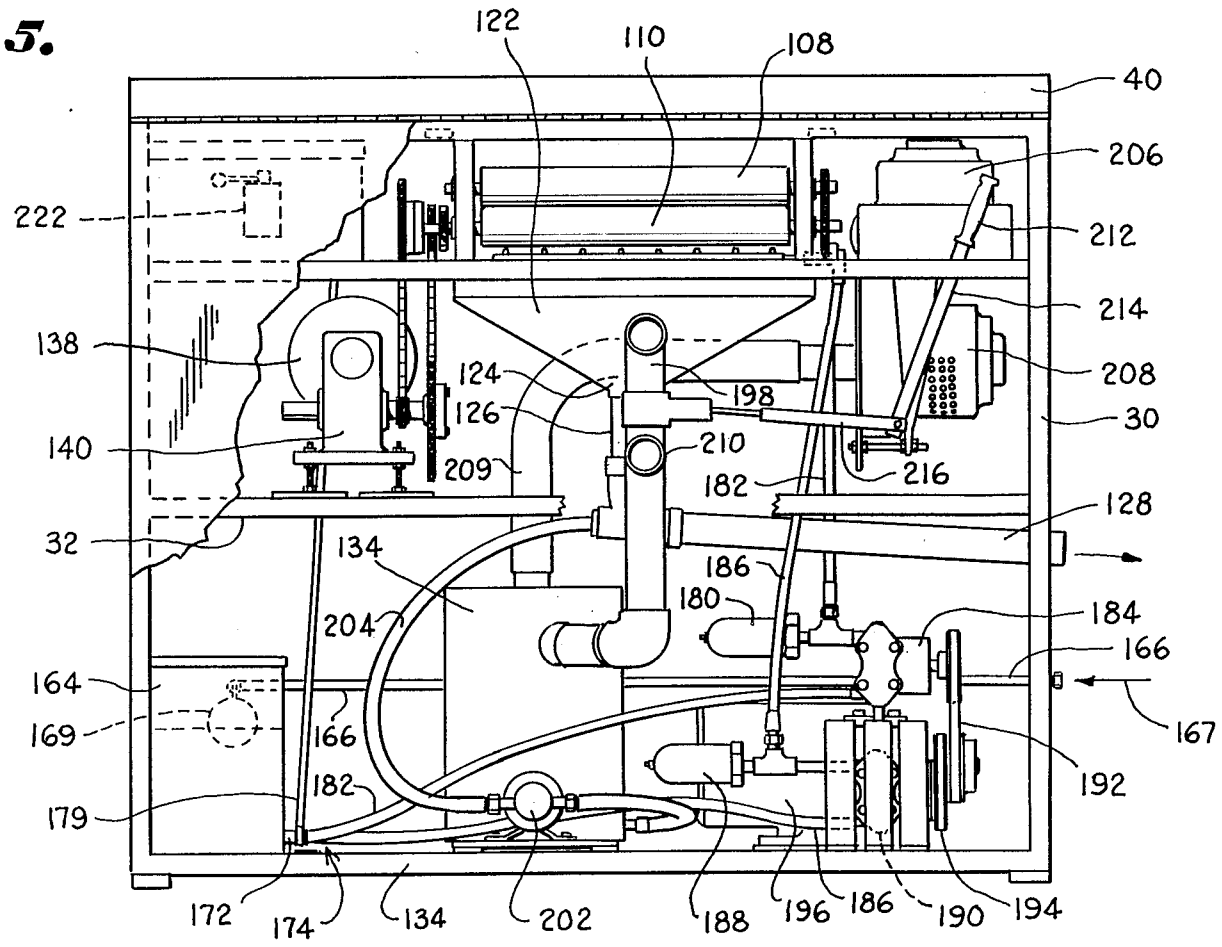
FIG. 5 is a rear elevational view, with parts cut away, of a carpet tile cleaning machine constructed in accordance with the present invention.

Two outlets 172, 174 are provided reservoir 164. A chemical supply 176, such as a drum of cleaning fluid or detergent, is provided for supplying chemicals through a conventional flow metering means 178 in conduit 179 into outlet 172. This allows for a detergent or other suitable cleaning fluid to be mixed with water emitted from outlet 172. A conventional pulsation dampener 180 is provided in a conduit 182 for improving the flow characteristics therein. Conduit 182 connects outlet 172 to washer nozzle bank 90 for emitting the cleaning fluid from nozzles 88 onto the pile side 82 of a carpet tile 56. As illustrated in FIG. 5, a pump 184 is provided for pumping fluid through conduit 182 and, accordingly, outwardly through nozzles 80 of nozzle bank 90.

Extending from outlet 174 of reservoir 164 is a conduit 186 which is connected to rinsing nozzle bank 106 for emitting plain water through nozzles 104 for rinsing the pile side 82 of a carpet tile 56. Another conventional pulsation damper 188 is provided in conduit 186 and functions similarly as does pulsation damper 180 to improve the flow characteristics in conduit 186. A pump 190, as shown in FIG. 5, is provided for pumping fluid upwardly through conduit 186 and outwardly from rinsing nozzles 104. Both pumps 184, 190 are connected by drive belt 192, 194, respectively, to an electric pump drive motor 196 mounted in a lower portion of carpet tile cleaning machine 10 to frame structure 12.

The vacuumed fluid path is illustrated in FIGS. 3 and 6. Fluid vacuumed from carpet tile 56 through vacuum slot 130 flows through a vacuumed fluid conduit 198 into vacuumed fluid reservoir 134. Vacuumed fluid reservoir 134 includes a conventional mercury float switch 199 which, when fluid level 200 in reservoir 134 reaches a certain height, works through a conventional control switching means 201 to actuate an electric pump 202 for pumping fluid therefrom through a conduit 204 to discharge conduit 128. Thus, the operation of mercury float switch 199 provides that the fluid level 200 in reservoir 134 will be maintained below a level which would impede the vacuum action of blower means 132 acting through vacuum slot 130, i.e., below the level where vacuumed fluid conduit 198 enters vacuumed fluid reservoir 134 at baffled entrance 205. As illustrated in FIG. 6, vacuum means 132 includes two vacuum pumps or electric blowers 206, 208 mounted in series such that the suction sides of blowers 206, 208 pull a vacuum through vacuumed fluid reservoir via conduit 209, as shown by arrows 211. The discharge side of blower 208 is directed downwardly through conduit 213 to the atmosphere in a lower portion of the machine 10.

The amount of cleaning and rinsing fluid applied to a carpet tile 56, the squeezing action of outfeed means 24, and the vacuum action of vacuum means 28 are interdependent upon one another and, acting together, allow for a carpet tile 56 to be cleaned and substantially dry when it exits machine 10. Consequently, upon exiting machine 10, carpet tiles 56 are ready to be reapplied to a floor surface. Thus, the present invention provides that the carpet tiles may be removed from the floor surface, cleaned, substantially dried, and reapplied to the floor surface in only a minimal amount of time. The size and configuration of machine 10 allows for it to be installed in a variety of locations and in a variety of environments.

When cleaning a carpet tile which is of narrower width than vacuum slot 130, vacuuming action of fluid from the carpet tile by vacuum slot 130 is reduced as air is pulled in around the edges of the narrower carpet tile. For this reason, an auxiliary outlet 210 is provided in vacuum fluid conduit 198 for allowing vacuum to be pulled selectively therefrom using an auxiliary vacuuming unit (not shown), instead of through vacuum slot 130 upon the actuation of handle 212. Handle 212 is attached to a lever 214 which is pivotally connected to the machine 10. Opposite to handle 212 of lever 214, a linkage rod member 216 is pivotally connected thereto. Linkage rod member 216 includes at the opposite end thereof a slide valve plate 218 which may be selectively introduced into vacuumed fluid conduit 198 for allowing the vacuum to be pulled either from vacuum slot 130 or outlet 210.

The auxiliary vacuuming unit for vacuuming an undersized carpet tile is not shown, but is a hand held device having a hose connectable to outlet 210 which is attached to a vacuum head similar to a conventional vacuum cleaner head. When the auxiliary vacuuming unit is not in use, it can be inserted in a storage shelf 220 provided in unloading station 16.

A reversing switch 222 is provided for allowing the rotation of drive means 136 to be reversed such that should a carpet tile become jammed within machine 10, the drive means 136 can be reversed for reversing scrubbing means 18, infeed means 20, and outfeed means 24 to allow the carpet tile to be backed out.

A control panel 224 is provided on the front 44 of the machine 10 and includes metering means 178, pump control switches for controlling pumps 184, 190, and vacuum control switches for controlling the vacuum operation of machine 10. A power shut-off switch 230 is provided for deactivating the machine entirely. Also provided, but not shown, is an interlock switch which is contactable with top cover 40 when top cover 40 covers machine 10. The interlock switch shuts down the operation of machine 10 upon the opening of top cover 40.

In operation, a carpet tile 56 is placed with pile side 82 down on loading station 14 and advanced manually until received in the nipping zone formed by rollers 62, 64. Rollers 62, 64 propel the carpet tile over wetting means 22 which subject the pile side of the carpet tile to a cleaning fluid spray via nozzles 88. The carpet tile is then propelled by rollers 62, 64 over scrubbing roller 76 which physically scrubs the pile side 82 of the carpet tile. After passing over scrubbing roller 76, the pile side is rinsed with a rinsing fluid spray emitted from nozzles 104. The carpet tile is then received in the nipping zone of rollers 108, 110, which serve to both propel the carpet tile from the carpet cleaning compartment 84 and also to squeeze excess fluid therefrom. Upon exiting rollers 108, 110, the carpet tile passes over vacuum slot 130 which further removes fluid remaining in the carpet tile such that the carpet tile is relatively moisture free after passing over vacuum slot 130. The carpet tile is then delivered finally to the unloading station 16 where it is then manually removed therefrom.

Should a carpet tile be narrower in width than the vacuum slot 130, the handle 212 can be actuated for allowing the auxiliary vacuuming unit to be connected to auxiliary vacuum outlet 210. Then, the carpet tile can be manually vacuumed with the auxiliary vacuuming unit.

It is to be understood that various couplings, fittings, connections, controls, etc., which are within the purview of one of ordinary skill in the art, can be used in the construction of carpet tile cleaning machine 10.

From the foregoing, it can be seen that the present invention provides a carpet tile cleaning machine for automatically cleaning, rinsing, and vacuuming carpet tiles in a manner which meets the objectives set forth above.

While one preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the art without departing from the spirit or scope of the following claims.

What is claimed is:

1. A subassembly for a carpet tile cleaning machine having a scrubbing device for scrubbing carpet tiles, such subassembly comprising:

a reservoir adapted for holding a fluid, said reservoir having inlet means adapted for allowing a fluid to be introduced therein, and outlet means comprising separate wetting outlet means and rinsing outlet means integral with reservoir and adapted for allowing a fluid to be discharged therefrom, respectively;

wetting means connected to said wetting outlet means and adapted for wetting a carpet tile with at least a fluid from said reservoir prior to the carpet tile being scrubbed by a scrubbing device of a carpet tile cleaning machine;

rinsing means connected to said rinsing outlet means and adapted for rinsing a carpet tile with a fluid from said reservoir after the carpet tile is scrubbed by a scrubbing device of a carpet tile cleaning machine;

pump means adapted for pumping fluid from said wetting and rinsing outlet means to said wetting means and said rinsing means, respectively;

drainage means associated with said wetting means and said rinsing means, said drainage means being adapted for receiving fluid emitted by said wetting means and said rinsing means;

vacuum means for vacuuming fluid from a carpet tile after the carpet tile has been subjected to rinsing fluid from said rinsing means;

a vacuumed fluid container connected to said vacuum means for receiving the fluid vacuumed from a carpet tile, said vacuumed fluid container being connected to said drainage means for allowing removal of the fluid therefrom through said drainage means; and vacuum pump means connected to said vacuumed fluid container and said vacuum means for drawing a vacuum in said vacuumed fluid container and said vacuum means.

2. A subassembly as defined in claim 1, further comprising:

a reservoir level sensing means associated with said reservoir adapted or sensing the fluid level of a fluid within said reservoir, said reservoir level sensing means being associated with said inlet means for allowing a fluid to be introduced into said reservoir upon said reservoir level sensing means sensing a fluid level below a predetermined fluid level;

drain pump means connected to said vacuumed fluid container and said drainage means and adapted for pumping fluid for said vacuumed fluid container into said drainage means; and container level sensing means associated with said vacuumed fluid container and adapted for sensing the fluid level of a fluid in said container level sensing means, said container level sensing means being associated with said drain pump means for allowing said drain pump means to pump fluid from said vacuumed fluid container into said drainage means upon a predetermined fluid level in said vacuumed fluid container being sensed by said container level sensing means.

3. A subassembly as defined in claim 2, wherein:

said reservoir level sensing means includes a mechanical float sensor and said inlet means includes a mechanically actuated valve, said mechanical float sensor being connected to said mechanically actuated valve for actuation thereof upon a fluid level in said reservoir being below a predetermined fluid level, for introduction of a fluid into said reservoir through said mechanically actuated valve; and wherein said drain pump means is electrically actuatable and said container level sensing means includes an electrically conductive fluid switch float sensor electrically connected to said drain pump means for electric actuation thereof, upon a predetermined fluid level being in said vacuumed fluid container, for pumping fluid therein to said drainage means.

4. A subassembly as defined in claim 1, wherein said vacuum pump means includes two vacuum pumps connected in series with one another.

5. A carpet tile cleaning machine as defined in claim 1, further comprising:

conduit means connecting said wetting outlet means to said wetting means and adapted for carrying fluid from said wetting means to said wetting means; and an additive inlet provided in said conduit means and adapted for allowing introduction of an additive into said conduit means for mixing with a fluid therein.

6. A carpet tile cleaning machine, comprising:

a frame structure;

a loading station connected to said frame structure and adapted for receiving a carpet tile;

an unloading station connected to said frame structure and adapted for allowing removal of a carpet tile from the carpet tile cleaning machine;

scrubbing means connected to said frame structure between said loading station and said unloading station and adapted for scrubbing a carpet tile;

infeed means connected to said frame structure between said loading station and said scrubbing means and adapted for transferring a carpet tile from said loading station and about said scrubbing means;

a reservoir adapted for holding a fluid, said reservoir having inlet means adapted for allowing a fluid to be introduced therein, and outlet means comprising separate wetting outlet means and rinsing outlet means integral with said reservoir and adapted for allowing fluid held in said reservoir to be discharged therefrom, respectively;

wetting means connected to said wetting outlet means and adapted for wetting a carpet tile with at least a fluid from said reservoir prior to the carpet tile being scrubbed by said scrubbing means;

outfeed means connected to said frame structure and adapted for transferring a carpet tile from about said scrubbing means to said unloading station;

rinsing means between said scrubbing means and said outfeed means, said rinsing means connected to said rinsing outlet means and adapted for rinsing a carpet tile with a fluid from said reservoir after the carpet tile is scrubbed by said scrubbing means;

pump means adapted for pumping a fluid from said outlet means to said wetting means and said rinsing means;

drainage means associated with said wetting means and said rinsing means, said drainage means being adapted for receiving fluid emitted by said wetting means and said rinsing means;

vacuum means adapted for vacuuming fluid from a carpet tile after the carpet tile has been subjected to said rinsing means;

a vacuumed fluid container connected to said vacuum means for receiving a fluid vacuumed from a carpet tile, said vacuumed fluid container being connected to said drainage means for allowing removal of the fluid therefrom through said drainage means; and vacuum pump means connected to said vacuumed fluid container and said vacuum means for drawing a vacuum in said vacuumed fluid container and said vacuum means.

* * * * *